United States Patent [19]

Schober et al.

[11] Patent Number: 4,865,096

[45] Date of Patent: Sep. 12, 1989

[54] LIGHTWEIGHT PILLOW TANK

[75] Inventors: Scott D. Schober; Marty M. Hawkins, both of Magnolia

[73] Assignee: American Fuel Cell and Coated Fabrics Company, Magnolia, Ark.

[21] Appl. No.: 232,717

[22] Filed: Aug. 16, 1988

[51] Int. Cl.[4] ..... B65D 88/22; B65D 33/14; B64D 37/06

[52] U.S. Cl. ..... 383/107; 244/135 B; 220/1 B

[58] Field of Search ..... 5/451; 244/135 B; 383/108, 107; 150/55; 441/35, 129, 133; 220/1 B

[56] References Cited

U.S. PATENT DOCUMENTS

| | | | |
|---|---|---|---|
| 2,696,235 | 12/1954 | Toffolon | 150/55 |
| 2,724,418 | 11/1955 | Krupp | 150/55 |
| 3,416,762 | 12/1968 | Headrick | 150/55 |

FOREIGN PATENT DOCUMENTS

| | | | |
|---|---|---|---|
| 1182561 | 6/1959 | France | 150/55 |
| 1315966 | 12/1962 | France | 150/55 |
| 1443272 | 5/1966 | France | 150/55 |
| 2476610 | 8/1981 | France | 220/1 B |
| 559951 | 3/1944 | United Kingdom | 150/55 |

*Primary Examiner*—Stephen Marcus
*Assistant Examiner*—Jes F. Pascua
*Attorney, Agent, or Firm*—Richards, Harris, Medlock & Andrews

[57] ABSTRACT

A lightweight pillow tank (10) is disclosed which includes upper and lower sections (12, 14) which are secured together along a seam (22) of predetermined width (24). A sleeve extends along a mid line of the width about the entire perimeter to the seam. Suitable holes or slits (32, 36) are formed through the outer material and the sleeve to permit a rope (34) to be threaded through portions of the sleeve to form tie-down points for the tank.

3 Claims, 2 Drawing Sheets

LIGHTWEIGHT PILLOW TANK

TECHNICAL FIELD

This invention relates to a lightweight fluid carrying tank, particularly adapted for transport.

BACKGROUND OF THE INVENTION

Lightweight fluid carrying tanks have many applications. For example, the military will frequently have need for a transportable fluid carrying tank that can be moved to a forward position in combat. Such tanks can hold water, gasoline, diesel fuel, jet fuel, heating oil, drinking water, transformer oil, or any other fluid desired, as long as the material of the tank is resistant to the particular fluid carried. While such tanks can come in almost any size, common sizes are 150, 250 and 500 U.S. gallons.

One advantage of such lightweight fluid tanks is their ready portability. Tanks can be mounted on the bed of a truck, on various sizes of trailers, used directly on the ground, usually without stabilizing aids, etc. It is desirable for such a tank to be so well constructed that it can be lifted off a surface when full without using special equipment, such as nets, harnesses, pallets or boxes to reinforce the tank. Further, such tanks should be capable of being secured in a particular position to prevent the tanks from moving when on a vehicle, or the like.

While prior tank designs have proven generally satisfactory, particularly the so-called pillow tank design formed of a tube of material closed at each end to resemble a pillow, there exists a need for improved tank designs which achieve the objectives set forth above, while remaining lightweight, inexpensive to manufacture and use, yet be reliable.

SUMMARY OF THE INVENTION

In accordance with one aspect of the present invention, a lightweight pillow tank is provided which includes a first section of material having a first edge and a second section of material having a second edge. The first and second edges are overlapped in a continuous band and secured together in a seam to form a fluid tight tank. A rope is inserted between the first and second edges in the band. The edge on the exterior of the tank is slit at predetermined positions to allow the rope to exit and re-enter the band to use the rope as a tie-down point.

In accordance with another aspect of the present invention, a sleeve is secured between the first and second edges at the band, the rope being inserted through the sleeve.

In accordance with another aspect of the present invention, the sleeve is formed of a synthetic polyester textile fiber such as Dacron and the rope is formed of a synthetic polyamide material such as nylon. The sections of material are formed of elastomeric coated cloth panels which are press-cured or autoclave-cured together along the band to form a seam.

BRIEF DESCRIPTION OF THE DRAWINGS

For a more complete understanding of the present invention and for further advantages thereof, reference is now made to the following description of the preferred embodiment taken in conjunction with the accompanying drawings, in which.

DETAILED DESCRIPTION

Figure 3:
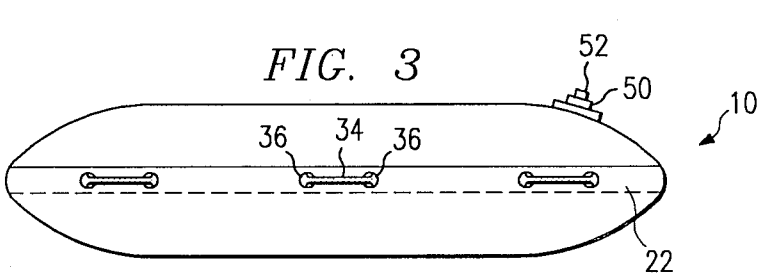
FIG. 3 is a side view of the tank of FIG. 2.
Figure 4:
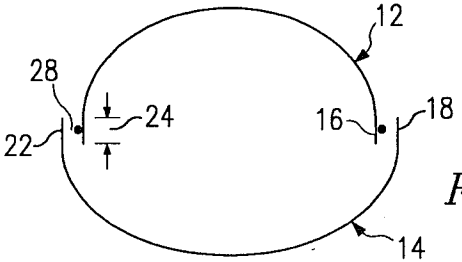
FIG. 4 is a vertical cross-sectional view of a tank illustrating its construction.

Referring now to the FIGURES, there is illustrated a lightweight pillow tank 10 which forms a first embodiment of the present invention. The tank 10 is formed of a tube defined by an upper rectangular section 12 and a lower rectangular section 14 bonded together at their side and end edges to form a fluid tight tank. While the sections can be made of any suitable material, they are typically elastomeric coated cloth panels. Such panels can be square woven nylon cloth with a coating of neoprene or SBR rubber. Typical nylon cloth weights found in such tanks would be 5 and 13 ounces per square yard. Other weave patterns of nylon cloth can be used. Further, it is believed that elastomeric coated aramid fibers would also be suitable for sections 12 and 14.

As seen in the FIGURES, the sections 12 and 14 are secured together by overlapping the first edge 16 of upper section 12 and the second edge 18 of lower section 14 a predetermined overlap about the entire periphery 20 of the tank, in a band or seam 22 of predetermined width 24. The edges 16 and 18 are typically press-cured or autoclave-cured together to form a bond which is usually stronger than the material of sections 12 and 14 alone.

Figure 5:
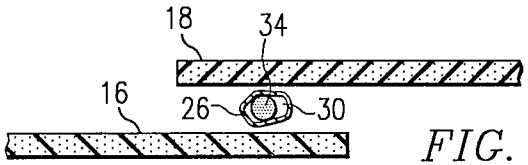
FIG. 5 is a detailed view of the seam in the tank.

As best seen in FIG. 5, a sleeve 26 is positioned between the first and second edges prior to curing at about the mid line 28 of the width 24. Preferably, the sleeve 26 extends about the entire periphery of band 22. When the edges are bonded together, the sleeve is securely locked between the material of the edges. Preferably, the sleeve is formed of a material such as a braided sleeve of synthetic polyester textile fiber such as Dacron, which will itself not be bonded together and will define an open passage 30 through it even after the edges are bonded together.

As seen in FIGS. 3, 7, 8 and 9, slits 32 can be formed through the exterior section edge 18 immediately above the sleeve 26 at certain positions around the periphery of the tank to expose the sleeve. A similar slit can be formed through the sleeve at each slit through the second edge 18.

A rope 34 can then be fed through one slit in the section edge and sleeve and passed through the passage 30 of the sleeve about the entire periphery of the tank. Whenever the rope is fed through sleeve 26 to the next mating slits in the second edge and sleeve, the rope can exit from the sleeve and extend exterior the tank for re-entry into the sleeve at the next pair of mating slits so that the exposed rope can be used as a tie-down point for the tank.

Figure 10:
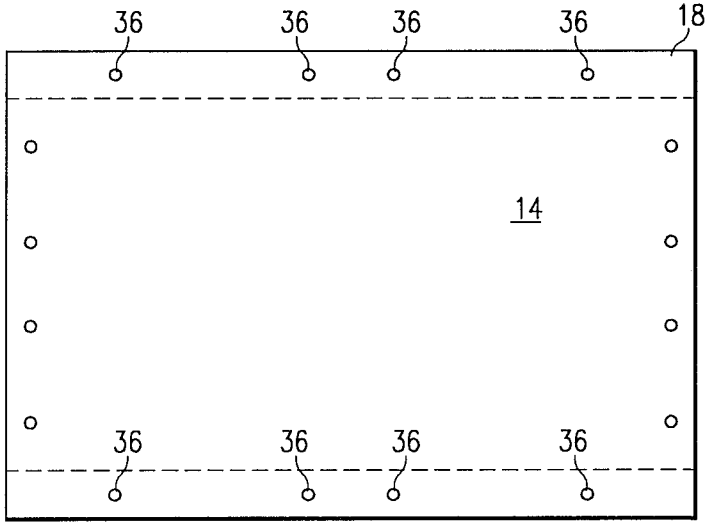
FIG. 10 is a layout view of one section of the tank illustrating the holes formed in the seam.

It will be appreciated that the sleeve and rope extend about the periphery of the tank at the mid-line 28 of band 22. Thus, should excessive stress be applied to the rope at one or more of the tie-down points to a degree to tear the material of the second edge 18, the tear will propagate along the mid-line of the band 22 and only in the material of the second edge. The fluid tight integrity of the tank will not be compromised. In addition to providing convenient tie-down points, the rope, if continuous around the periphery of the tank, provides enhanced stability for the tank about its girth. FIG. 10 illustrates a lower section 14 having a predetermined distribution of holes 36 in the section edge 18 which substitute for the slits illustrated other FIGURES. It will be understood that while rope 34 has been described, rope is herein meant to incorporate any suitable tie-down material, including straps or webbing. The rope 34 can, for example, comprise nylon rope.

In one tank constructed in accordance with the teachings of the present invention, the width 24 of the band 22 was seven inches. A ¾ inch dacron sleeve was secured between the mating edges as they were cured together to form the seam. A ½ inch diameter nylon rope was subsequently fed through the sleeve to provide the tie-down points.

It will be understood that slits or holes through edge 18 can be placed anywhere along the band or seam and repeated as many times along the band as needed. Where the rope exits from the sleeve, and re-enters into the sleeve at the next slit or hole, the rope provides a handle, tie-down point, or structure for securing an accessory item to the tank. The sleeve not only results in an easy, inexpensive, installation of the rope, but also provides a flexible, low friction conduit that significantly reduces localized stresses in the tank that arise in some tie-down configurations.

The size of the rope should be chosen according to the load that is to be put on the handle or tie-down geometry during both static and dynamic tank use. The load on the rope is affected by the specific gravity of the fluid held in the tank, the number of tie-down points, the design G loading of the tank (acceleration and deceleration) when being transported or lifted by a vehicle such as a truck or aircraft, and the direction that the G loading is applied with respect to the tank, the size of the tank, and the geometry of the tie-down point.

The sleeve is adequately adhered to the seam area where edges 16 and 18 are bonded together to remain in place during the threading of the rope, but the interior surface of the sleeve will not adhere to itself even after the press-cure of the seam. While dacron fits this need, other suitable sleeve materials can be chosen according to the environmental conditions encountered during tank use. It has been determined, if rope is used, the sleeve should be approximately ⅛ inch larger in diameter than the rope itself. If webbing is used which has a width to thickness ratio greater than approximately 16: 1, the sleeve should be approximately ⅛ inch larger in flat width than the webbing. If the webbing has a width to thickness ratio of less than approximately 16: 1, the sleeve should be approximately ¼ inch larger in flat width than the webbing.

The sleeve and rope are placed along the mid-line of the bonded areas of the edges 16 and 18. Preferably, the seam width on either side of the sleeve is sufficient to provide a seam strength greater than the strength of the coated fabric to prevent loss of tank contents under any type of catastrophic overloading of the tie-down system. That is, the width 24 should be twice the width necessary to form a secure seam for the intended use of the tank, plus the width of the sleeve 26. Should the rope be pulled perpendicular to the plane of the band or seam and literally tear through the coated fabric of the upper layer of the seam, the remaining seam width bonding the outer panel to the inner panel will keep the tank from rupturing. Should the handle be overloaded in a fashion that may de-laminate the seam along either the side of the inner panel edge or along the outer panel edge, the remaining seam width will keep the tank from rupturing no matter which edge of the seam is delaminated.

Preferably, the rope exit and entry holes or slits should be spaced approximately eight inches apart to form handles on the sides of the tank, and approximately eight inches to sixteen inches apart at the corners of the tank. Each corner should have exit and re-entry holes or slits that extend diagonally across the corner, rather than exiting the side and extending straight along the side of the tank until it must make a 90° turn to re-enter the enclosure band. When the rope is strapped down under tension, it may assume a right angle orientation parallel to the side and ends of the tank that is undesirable in the stressed condition.

Figure 1:
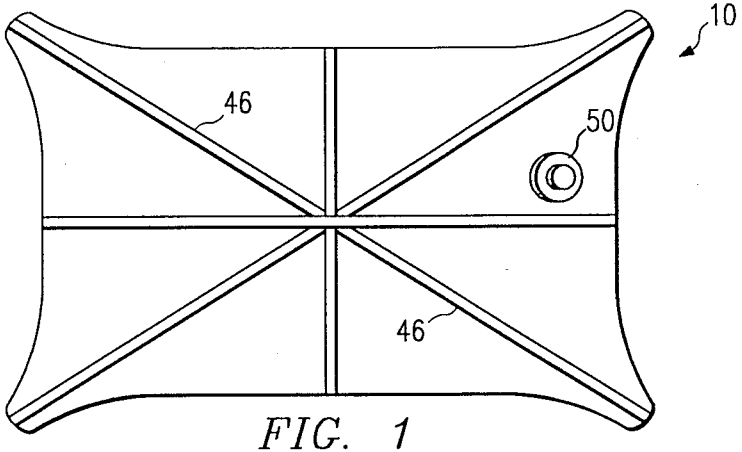
FIG. 1, is a top view of a pillow tank designed in accordance with the teachings of the present invention.
Figure 2:
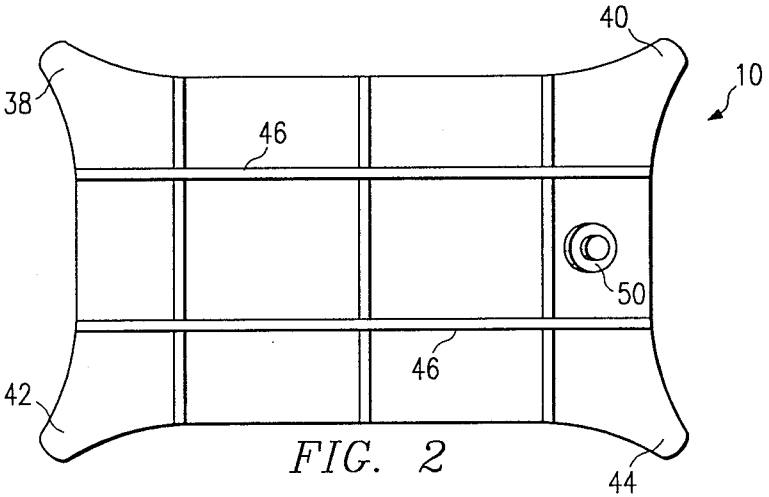
FIG. 2 is top view of a pillow tank designed in accordance with the teachings of the present invention.
Figure 7:
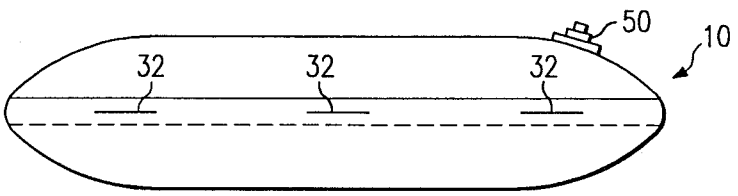
FIG. 7 is a side view of the tank illustrating the slits to access the rope.
Figure 8:
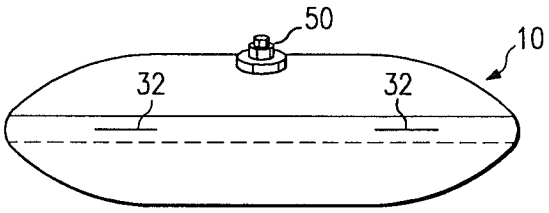
FIG. 8 is an end view of the tank illustrating the slits to access the rope.
Figure 9:
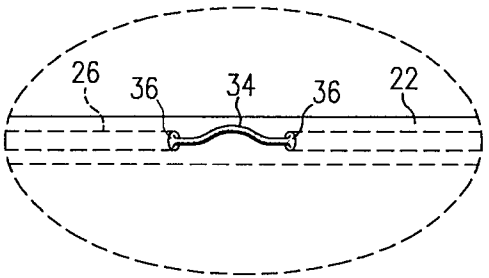
FIG. 9 is an end view of the tank illustrating the handle.
Figure 6:
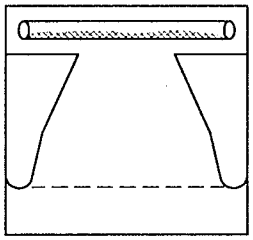
FIG. 6 is a detailed view of the end closure of the tank.

Generally, for smaller tank sizes containing liquids with specific gravities of about 1 and under normal ground transportation loads, the tank need only be tied down as the four corners 38, 40, 42 and 44. Preferably, exterior strapping 46, as shown in different configurations in FIG. 1 and 2, can be sewn or secured to the tank for added strength. The hook of a ratchet type webbing tie-down can be placed over the rope at one corner while the other end of the ratchet tie-down is attached to the vehicle and the ratchet operated to apply tension to the rope until the rope is aligned with the direction of the band at the point it exits or enters the band. Securing the tanks at the corners greatly increases the stability of the partially filled tanks during forward and aft accelerations compared to conventional belt loop type securing systems. The tank exhibits no undesirable side motion when just secured at the corners even when subjected to a wide variety of forward, aft and lateral accelerations. If lateral movement does occur, this can be readily controlled by the addition of side tie-down points.

Suitable tank filling and discharge apparatus 50 can be mounted on the tank, as well as a vent 52 if desired.

Although the present invention has been described with respect to its specific preferred embodiment thereof, various changes and modifications may be suggested to one skilled in the art, and it is intended that the present invention encompass such changes and modifications as fall within the scope of the appending claims.

We claim:

1. A lightweight pillow tank, comprising:

a first section of material having a first edge;

a second section of material having a second edge;

the first and second edges overlapping each other in a continuous seam, the edges being secured together at the seam to form a fluid type tank;

a rope inserted between the first and second edges in the seam; and openings at predetermined positions through the outer edge to expose the rope, the rope acting as a tie-down point.

2. The lightweight pillow tank of claim 1 further comprising a sleeve secured between the first and second edges in the seam, the rope passing through the sleeve.

3. The lightweight pillow tank of claim 1 wherein the sections are formed of elastomeric coated cloth panels, the sleeve is formed of dacron, and the rope is formed of nylon.

* * * * *